US006837545B1

(12) United States Patent
Ho

(10) Patent No.: US 6,837,545 B1
(45) Date of Patent: Jan. 4, 2005

(54) CHAIR ARM WITH AN ADJUSTABLE HEIGHT

(76) Inventor: Hsueh Yu Ho, No. 198, Lane 401, Sec. 1, Yongsing Rd., Wuci Township, Taichung County (TW)

( * ) Notice: Subject to any disclaimer, the term of this patent is extended or adjusted under 35 U.S.C. 154(b) by 0 days.

(21) Appl. No.: 10/664,953

(22) Filed: Sep. 22, 2003

(51) Int. Cl.[7] ..... A47C 7/54
(52) U.S. Cl. ..... 297/411.36
(58) Field of Search ..... 297/411.36, 411.35, 297/411.2; 248/118.3, 118

(56) References Cited

U.S. PATENT DOCUMENTS 5,265,938 A * 11/1993 Melhuish et al. ..... 297/411.36
5,435,626 A * 7/1995 Lai ..... 297/411.36
5,895,095 A * 4/1999 Chen ..... 297/411.36
5,997,093 A * 12/1999 Gollin et al. ..... 297/411.36
6,296,313 B1 * 10/2001 Wu ..... 297/411.35
6,419,323 B1 * 7/2002 Chu et al. ..... 297/411.36
6,585,322 B1 * 7/2003 Lai ..... 297/411.36
6,659,561 B1 * 12/2003 Lee ..... 297/411.35

* cited by examiner

*Primary Examiner*—Milton Nelson, Jr.
(74) *Attorney, Agent, or Firm*—Rosenberg, Klein & Lee

(57) ABSTRACT

A chair arm includes an inner post having a first end secured on a chair and a second opposite to the first end of the inner post. The inner post includes a first slot longitudinally defined therein near the second end of the inner post and extending through the inner post. The first slot has two opposite sides each having a series of first indentations defined in the inner post. An outer post is sleeved on the inner post. The outer post has a through hole defined therein and communicating with the first slot when the outer post partially receiving the inner post. A locking device is reciprocally slidably mounted in the through hole and extending into the inner post to selectively hold the outer post in place.

16 Claims, 8 Drawing Sheets

CHAIR ARM WITH AN ADJUSTABLE HEIGHT

BACKGROUND OF THE INVENTION

1. Field of the Invention

The present invention relates to a chair arm, and more particularly to a chair arm with an adjustable height.

2. Description of Related Art

A conventional chair arm with an adjustable height in accordance with the prior art shown in FIG. 8 comprises an inner post (6) adapted to be secured on a chair, an outer post (63) slidably receiving the inner post (6), an actuator (7) securely connected to the outer post (63) and a clutch (8) pivotally connected to the outer post (4) selectively engaging the inner post (6) to hold the outer post (63) in place.

An adjust seat (61) is securely received in the inner post (6). A passage (611) is longitudinally defined in the adjust seat (61) and a series of slots (612) are laterally defined in an inner periphery of the passage (611). A slider (62) is partially slidably received in the passage (611). The slider (62) has a top end secured on the outer post (63) that has a top end adapted to be connected to a cushion (not shown) of the chair. The slider (62) includes a channel (621) defined in one side thereof for receiving the actuator (7). The actuator (7) has a groove (71) longitudinally defined therein and multiple bolts (72) extending through the groove (71) and screwed into the slider (62) such that the actuator (7) can be reciprocally longitudinally moved relative to the slider (62). The actuator (7) includes a handle (73) secured thereon and extending through the outer post (63) for handling by a user in upwardly driving the actuator (7). A spring (74) is mounted between the slider (62) and the actuator (7) for providing a restitution force to the actuator (7) after being upwardly moved. A clutch (8) is pivotally mounted between the slider (62) and the actuator (7). The clutch (8) has a stopper (81) extending therefrom. The stopper (81) is selectively engaged to a corresponding one of the series of slots (612) in the adjust seat (61) to hold the outer post (63) in place when being adjusted to a suitable height. The actuator (7) has a raised portion (75) extending therefrom and corresponding to the clutch (8) for driving the clutch (8) and making the stopper (81) detach from the adjust seat (61).

To adjust the height of the conventional chair arm, the actuator (7) is upward moved to make the raised portion (75) press the clutch (8). The outer post (63) can be slidably moved relative to the inner post (6) to adjust the height of the chair arm when the clutch (8) is pressed and the stopper (81) is disengaged relative to the series of slots (612). The handle (73) is released when the outer post (63) extends to a suitable height and the stopper (81) engaged to the slots (612) again.

However, the conventional chair arm has a complicated structure for adjusting the height thereof. Consequently, the manufacturing processes are complicated and the manufacturing cost is high.

Furthermore, the actuator (7) is moved to press the clutch (8) to make the stopper (81) detach from the slot (612) in the adjust seat (61). The height of the conventional chair arm may not be adjusted when the raised portion (75) and the clutch are worn and torn.

The present invention has arisen to mitigate and/or obviate the disadvantages of the conventional chair arm that has an adjustable height.

SUMMARY OF THE INVENTION

The main objective of the present invention is to provide an improved chair arm with an adjustable height.

To achieve the objective, the chair arm in accordance with the present invention comprises an inner post having a first end adapted to be secured on a chair and a second end opposite to the first end of the inner post. The inner post includes a first slot longitudinally defined therein near the second end of the inner post and extending through the inner post. The first slot has two opposite sides each having a series of first indentations defined in the inner post. An end piece is attached to the second end of the inner post for closing the inner post and extending into the inner post. The end piece includes a channel defined therein and corresponding to the first slot in the inner post. An outer post is sleeved on the inner post and the inner post partially received in the outer post. The outer post has a through hole defined therein and communicating with the first slot when the outer post is partially receiving the inner post. The outer post has a top end adapted to be securely connected to a cushion of the chair. A locking device is reciprocally slidably mounted in the through hole and extending into the inner post to selectively hold the outer post in place.

Further benefits and advantages of the present invention will become apparent after a careful reading of the detailed description with appropriate reference to the accompanying drawings.

DETAILED DESCRIPTION OF THE INVENTION

Figure 1:
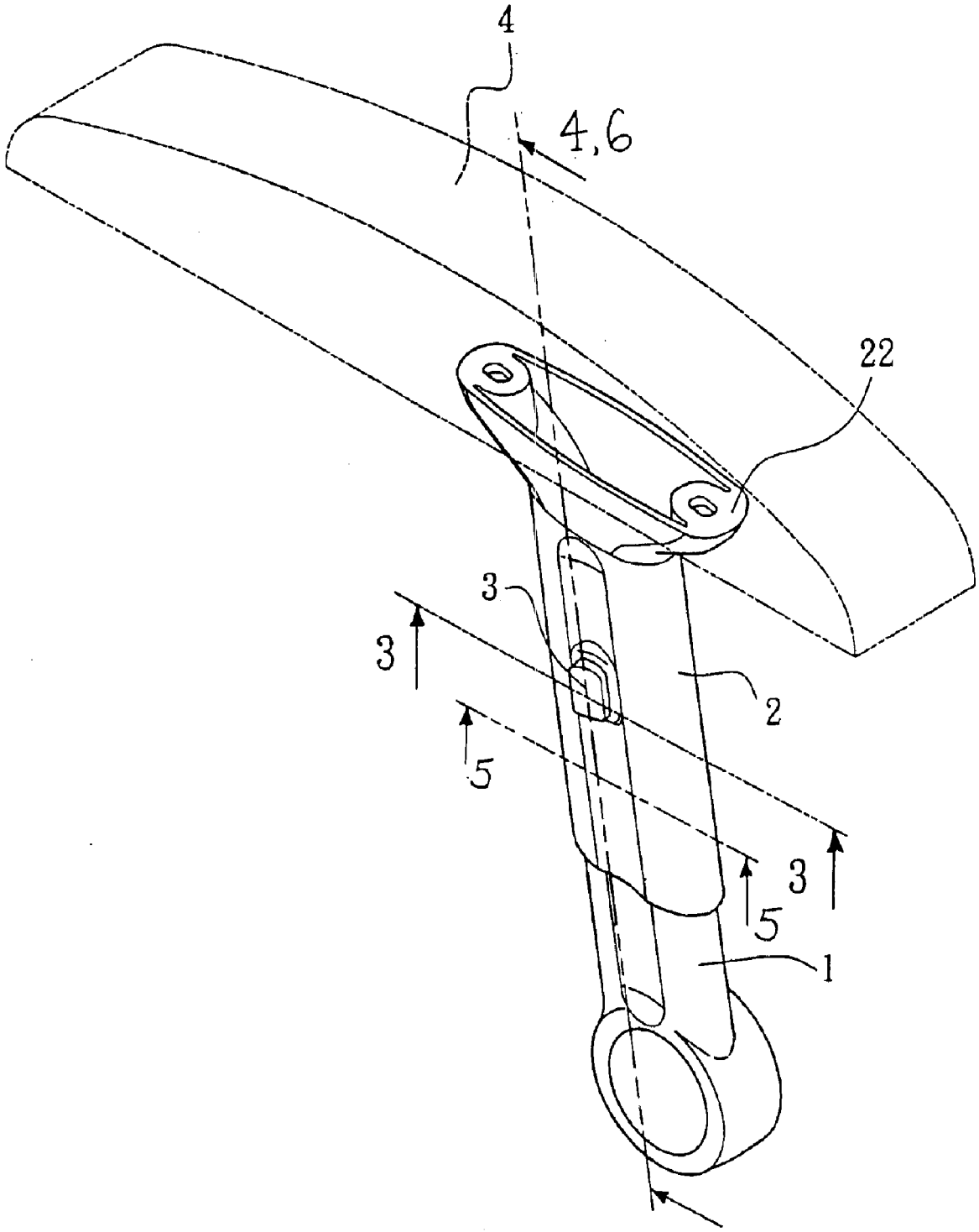
FIG. 1 is a perspective view of a chair arm with an adjustable height in accordance with the present invention.

Referring to the drawings and initially to FIGS. 1–4, a chair arm with an adjustable height in accordance with the present invention comprises inner post (1), an outer post (2) partially receiving the inner post (1), a locking device (3) extending through the inner post (1) and the outer post (2) for selectively positioning the outer post (2) relative to the inner post (1).

The inner post (1) includes a first end adapted to be secured on a chair and a second end opposite to the first end of the inner post (1). The inner post (1) has a first slot (11) longitudinally defined in the inner post (1) near the second end of the inner post (1) and extending through the inner post (1). The first slot (11) has two opposite longitudinal sides each having a series of first indentations (111). The inner post (1) has a second slot (12) longitudinally defined therein near the second of the inner post (1) and corresponding to the first slot (11) in the inner post (1). The second slot (12) extends through the inner post (1) and has two opposite longitudinal sides each having a series of second indentations (121) defined in the inner post (1). The series of second indentations (121) interactively correspond to the series of first indentations (111).

An end piece (13) inserted into the inner post (1) from the second end of the inner post (1) and secured on the second end of the inner post (1). The end piece (13) includes a cover (131) attached to the second end of the inner post (1) for closing the inner post (1) and two rails (132) downward extending from the cover (131) into the inner post (1) such that a channel (133) is defined between the two rails (132). The channel (133) corresponds to the first slot (11) and the second slot (12) in the inner post (1).

The outer post (2) is telescopically sleeved on the inner post (1). The outer post (2) includes a through hole (21) laterally defined therein and communicating with the first slot (11) when the outer post (2) is sleeved on the inner post (1). The outer post (2) has an enlarged portion (22) formed on a top end of the outer post (2) and adapted to be securely connected to a cushion (4) of the chair.

The locking device (3) includes a button (31) reciprocally moveably received in the through hole (21) in the outer post (2) and partially extending out of the outer post (2). A protrusion (35) laterally extends from the button (31) and has a width slightly smaller than that of the first slot (11) in the inner post (1). The protrusion (35) is slidably received in the first slot in the inner post (1). The protrusion (35) includes two opposite sides each having at least one buckle (34) laterally extending therefrom. The buckle (34) is selectively engaged to a corresponding one of the series of first indentations (111) to hold the outer post (2) in place. In the preferred embodiment of the present invention, each opposite sides of the protrusion (35) has two buckles (34) extending therefrom. A shank (32) longitudinally extends from the protrusion (35) through the channel (133) and the second slot (12) in the inner post (1). The shank (32) has a width slightly smaller than that of the second slot (12) such that the shank (32) is partially slidably received in the second slot (12) when adjusting the height of the chair arm of the present invention. The shank (32) has two opposite sides each having a stopper (33) laterally extending therefrom near a free end of the shank (32) and abutting the rails (132) of the end piece (13) to prevent the locking device (3) from detaching from the chair arm. Each stopper (33) is selectively received in a corresponding one of the series of second indentations (121) to guide a buckle (34) to align with a corresponding one of the first indentations (111) and secure the position of the locking device (3). A resilient member (37) is compressively sleeved on the shank (32) between the protrusion (35) and the rails (132) to provide a restitution force to the locking device (3) after being pressed. The resilient member (37) has a first end abutting the protrusion (35) and a second end abutting the rails (132) of the end piece (13). In the preferred embodiment of the present invention, the resilient member (37) is a spring.

Figure 2:
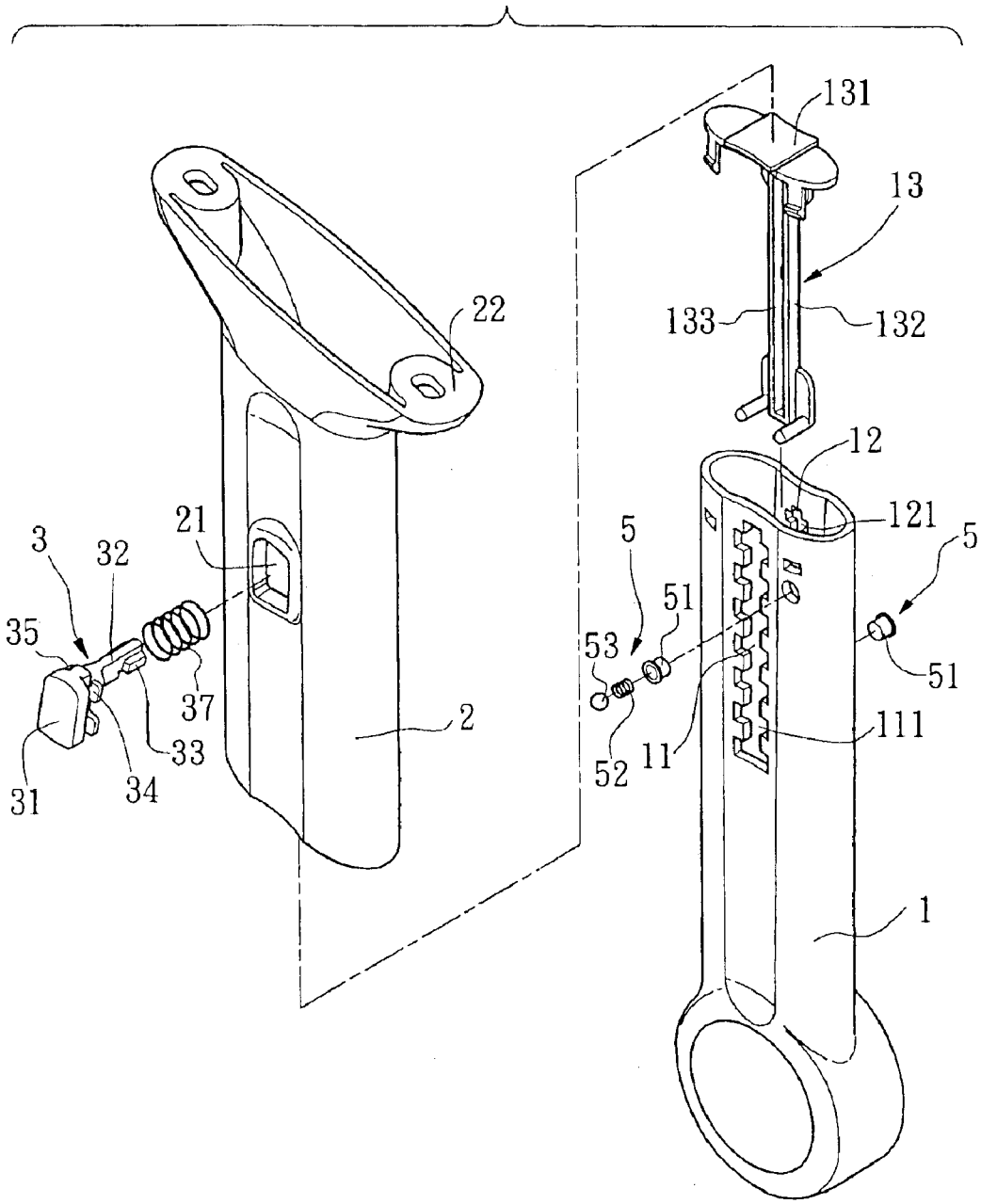
FIG. 2 is an exploded perspective view of the chair arm in FIG. 1.
Figure 3:
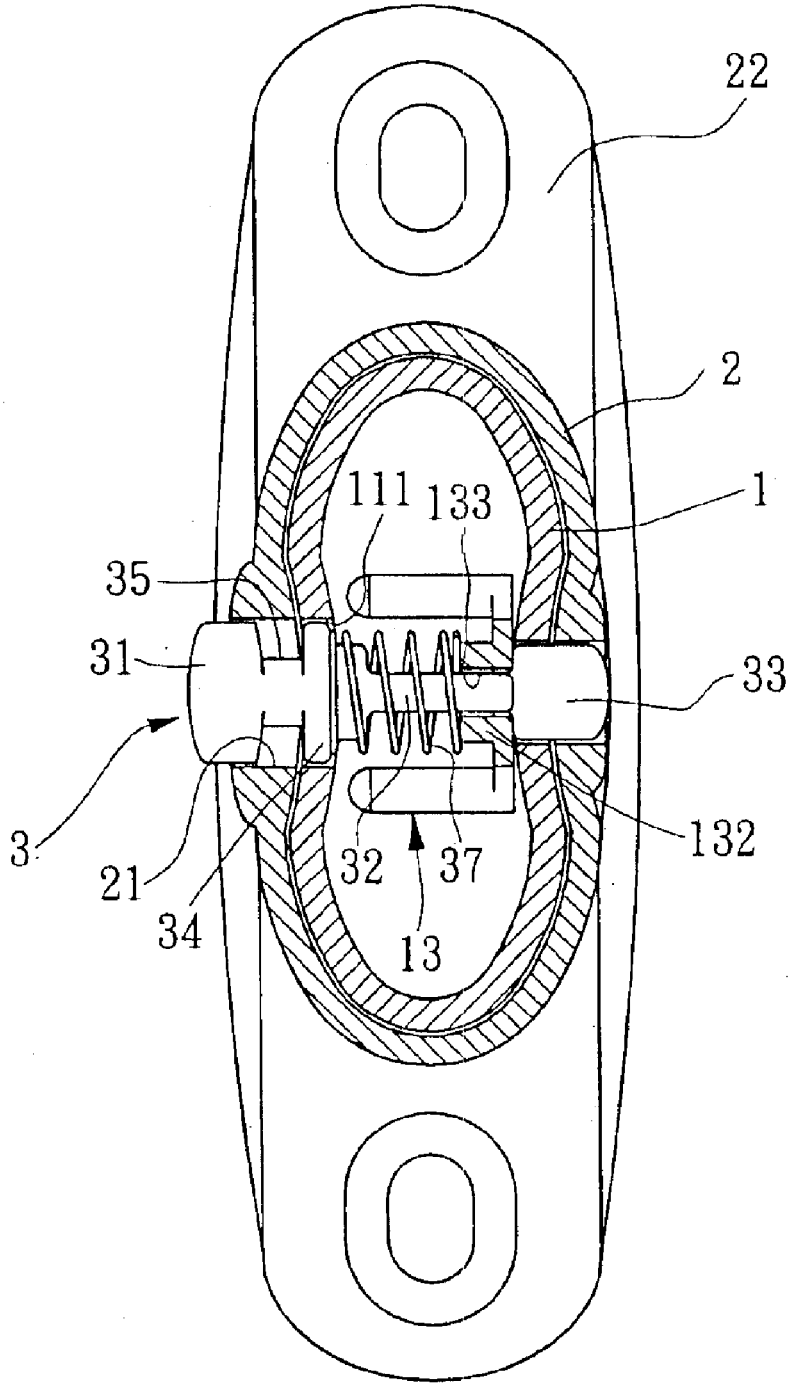
FIG. 3 is a partially cross-sectioned view of the chair arm taken along sectional line 3—3 in FIG. 1.
Figure 4:
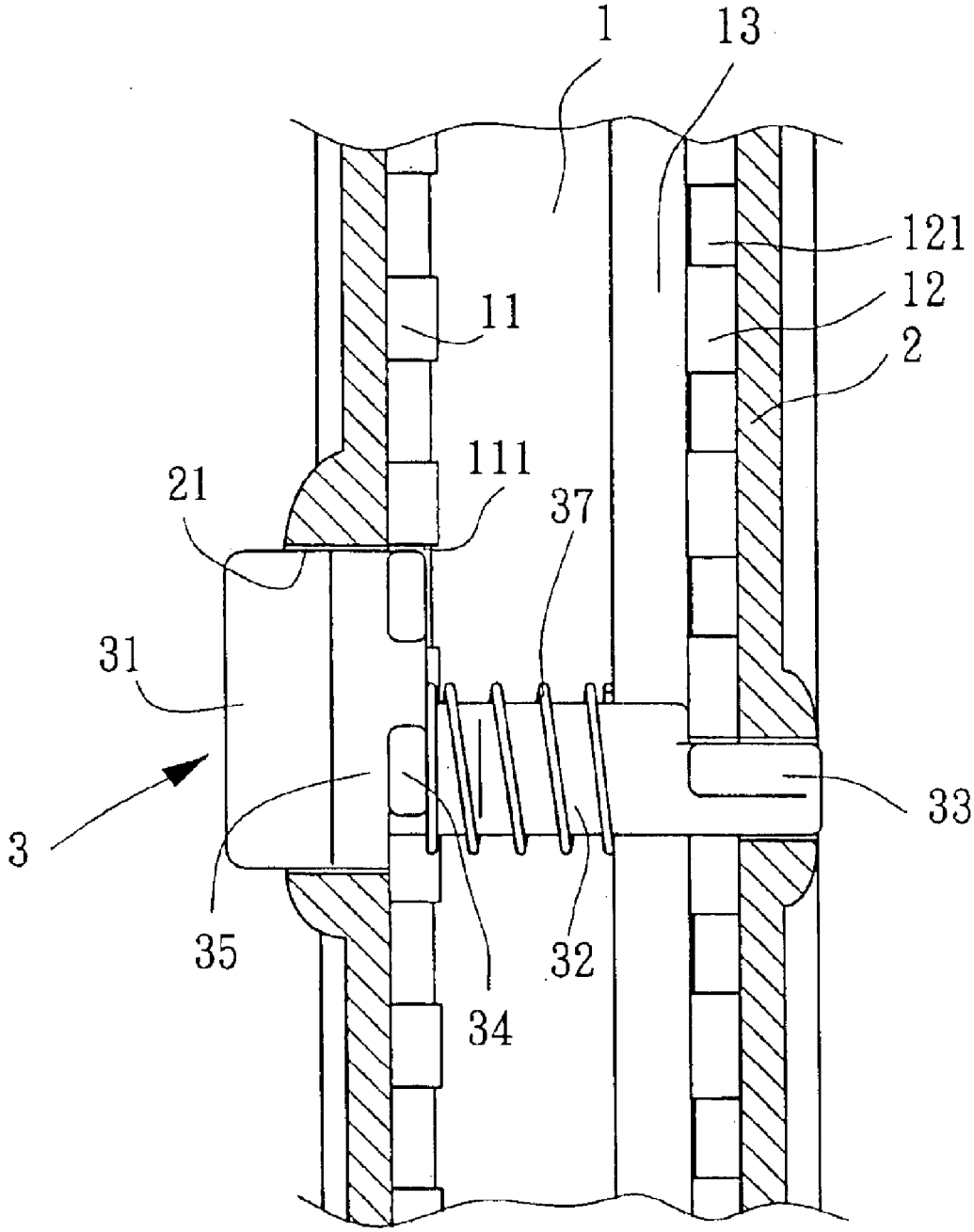
FIG. 4 is a partially cross-sectioned view of the chair arm taken along sectional line 4—4 in FIG. 1.
Figure 5:
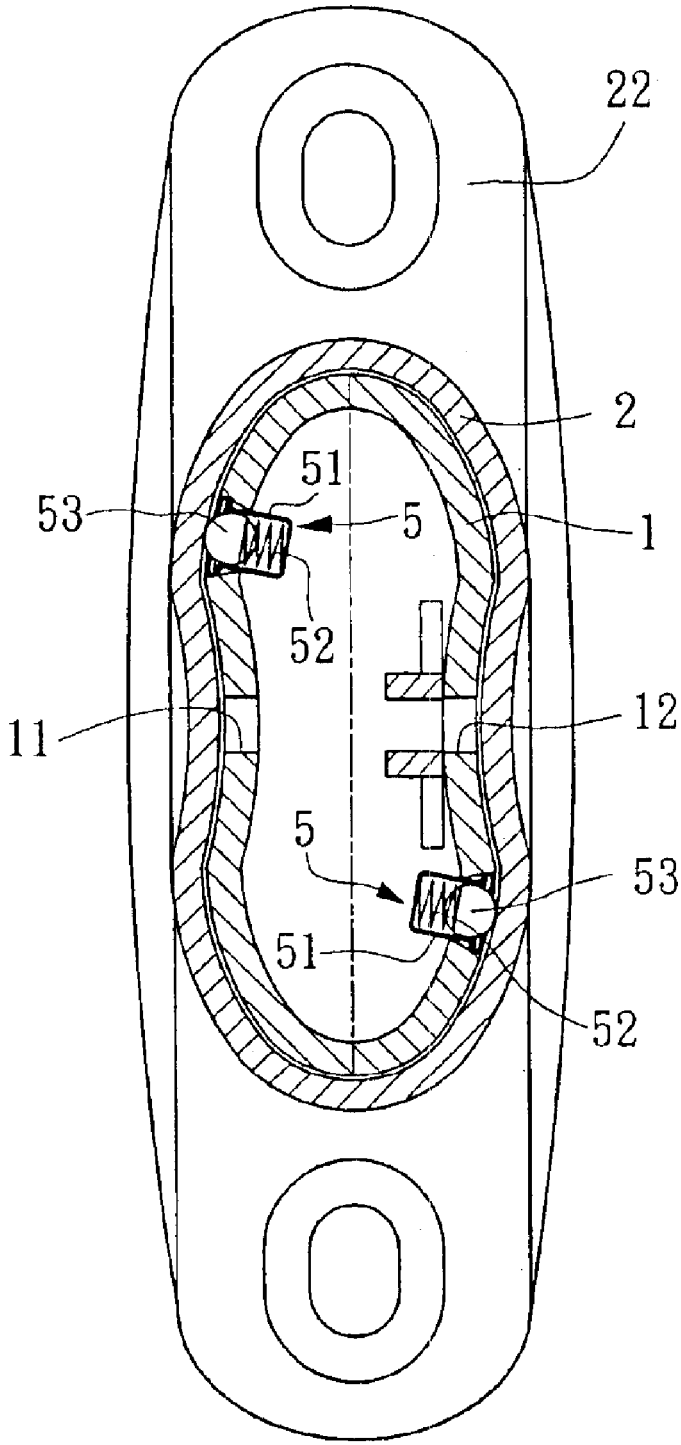
FIG. 5 is another partially cross-sectioned view of the chair arm taken along sectional line 5—5 in FIG. 1.

With reference to FIGS. 2 and 5, the chair arm in accordance with the present invention further comprises two pushers (5) each mounted in two opposite sides of the inner post (1) and abutting against the inner periphery of the outer post (2) to prevent the outer post (2) from shaking due to a gap between the inner post (1) and the outer post (2). The pusher (5) includes a seat (51) secured in the inner post (1), a spring (52) compressively received in the seat (51) and a steel ball (53) partially received in the seat (51). The steel ball (53) extends to abut the inner periphery of the outer post (2).

Figure 6:
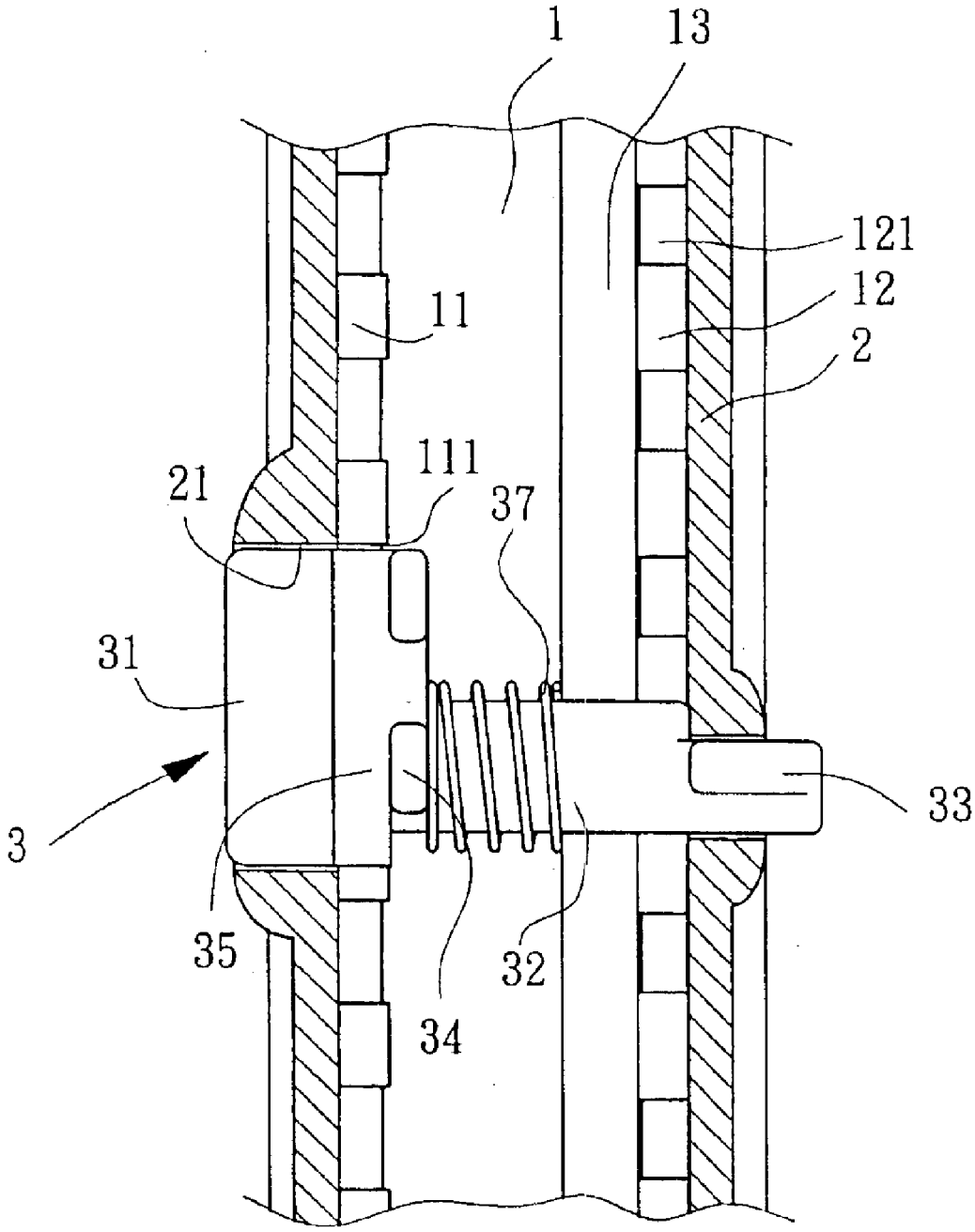
FIG. 6 is a partially cross-sectioned view of the chair arm taken along sectional line 6—6 in FIG. 1 when the button is pressed.
Figure 7:
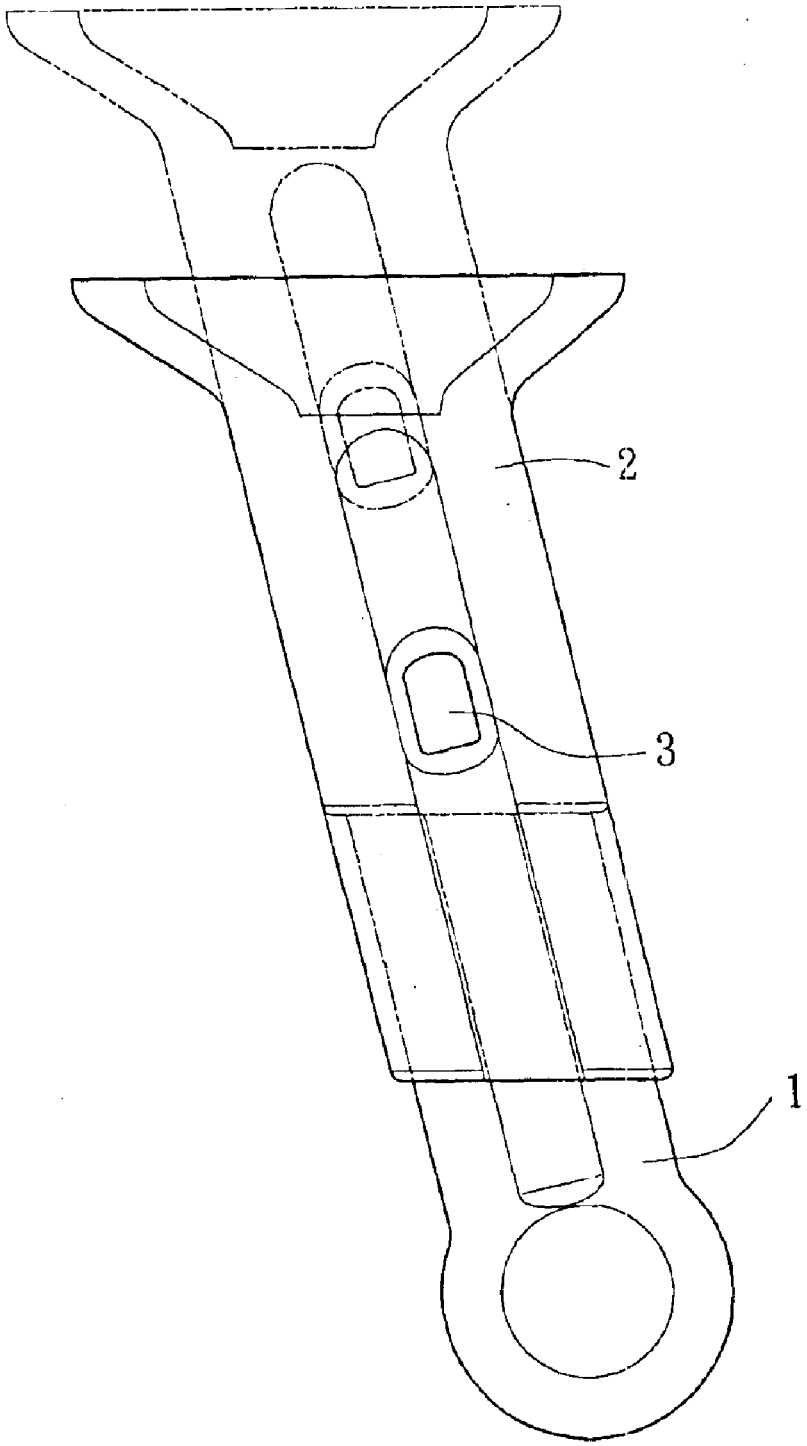
FIG. 7 is an operational side plan view of the chair arm of the present invention.
Figure 8:
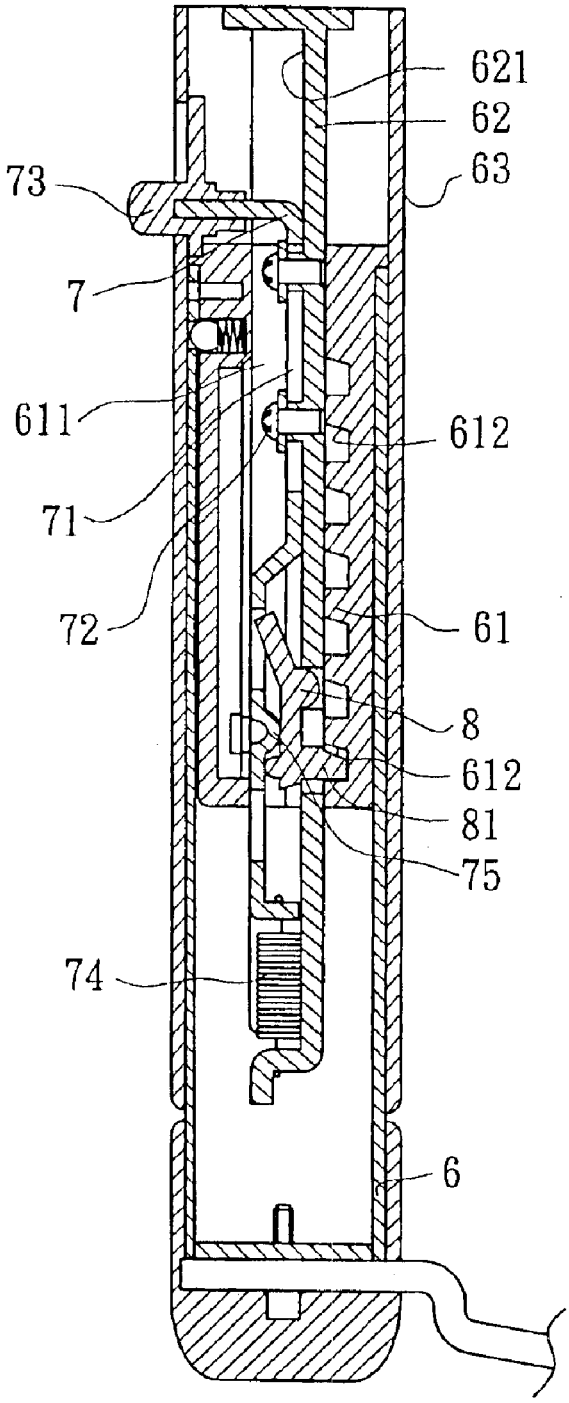
FIG. 8 PRIOR ART
FIG. 8 is a front cross-sectional view of a conventional chair arm in accordance with the prior art.

To operate the chair arm of the present invention, with reference to FIGS. 5 and 6, the button (31) is inwardly pressed relative to the chair arm, thereby the buckles (34) and the stoppers (33) are respectively detached from the first indentations (111) and the second indentations (121). Consequently, the protrusion (35) and the shank (32) are respectively freely received in the first slot (11) and the second slot (12), and the outer post (2) can be moved relative to the inner post (1) to adjust the height of the chair arm of the present invention.

As described above, the structure of the chair arm has been advantageously altered, thereby the costs of manufacturing and assembling are reduces and the user only needs to press the button (31) when adjusting the height of the chair arm. The bolts of the conventional adjustable chair arm are unnecessary to the present invention, thereby the manufacturing processes are simplified to save the time of manufacture the chair arm in accordance with the present invention.

Although the invention has been explained in relation to its preferred embodiment, it is to be understood that many other possible modifications and variations can be made without departing from the spirit and scope of the invention as hereinafter claimed.

What is claimed is:

1. A chair arm with an adjustable height, comprising:

an inner post having a first end adapted to be secured on a chair and a second end opposite to the first end of the inner post, the inner post including a first slot longitudinally defined therein near the second end of the inner post and extending through the inner post, the first slot having two opposite sides each having a series of first indentations defined in the inner post;

an end piece attached to the second end of the inner post for closing the inner post and extending into the inner post, the end piece including a channel defined therein and corresponding to the first slot in the inner post;

an outer post sleeved on the inner post and the inner post partially received in the outer post, the outer post having a through hole defined therein and communicating with the first slot when the outer post partially receives the inner post, the outer post having a top end adapted to be securely connected to a cushion of the chair; and a locking device reciprocally slidably mounted in the through hole and extending into the inner post to selectively hold the outer post in place, the locking device including:

a button reciprocally moveably received in the through hole in the outer post and extending out of the outer post for a user to operate the locking device;

a protrusion laterally extending from the button and selectively slidably received in the first slot in the inner post, the protrusion including two opposite sides each having at least one buckle laterally extending therefrom, the buckles selectively engaged to a corresponding one of the first indentations in the inner post to hold the outer post in place relative to the inner post;

a shank longitudinally extending from the protrusion through the channel in the end piece, the shank has two opposite sides each having a stopper laterally extending from a free end after extending through the channel in the end piece, the two stoppers abutting the end piece to prevent the locking device from detaching from the chair arm; and a resilient member compressively sleeved on the shank between the protrusion and the end piece to provide a restitution force to the locking device after being pressed.

2. The chair arm as claimed in claim 1, wherein the resilient member is a spring.

3. The chair arm as claimed in claim 1, wherein the inner post comprises a second slot longitudinally defined therein near the second end of the inner post and extending through the inner post, the second slot corresponding to the first slot in the inner post, the second slot having two opposite longitudinal sides each having a series of second indentations defined in the inner post, each stopper of the locking device selectively received in a corresponding one of the series of second indentations to secure the position of the locking device.

4. The chair arm as claimed in claim 3, wherein the resilient member is a spring.

5. The chair arm as claimed in claim 3 further comprising two pushers respectively mounted in the inner post and abutting against an inner periphery of the outer post to prevent the outer post from shaking due to a gap between the inner post and the outer post.

6. The chair arm as claimed in claim 3, wherein the outer post comprises an enlarged portion formed on the top end of the outer post, the enlarged portion adapted to be securely connected to a cushion of the chair.

7. The chair arm as claimed in claim 6, wherein the resilient member is a spring.

8. The chair arm as claimed in claim 1, wherein the end piece comprises a cover attached to the second end of the inner post for closing the inner post and two rails downwardly extending from the cover to define the channel, the second end of the resilient member abutting the rails and the stopper engaged to at least one of the rails to prevent the locking device from detaching from the chair arm.

9. The chair arm as claimed in claim 8, wherein the inner post comprises a second slot longitudinally defined therein near the second end of the inner post and extending through the inner post, the second slot corresponding to the first slot in the inner post, the second slot having two opposite longitudinal sides each having a series of second indentations defined in the inner post, each stoppers of the locking device selectively received in a corresponding one of the series of second indentations to secure the position of the locking device.

10. The chair arm as claimed in claim 9, wherein the resilient member is a spring.

11. The chair arm as claimed in claim 8, wherein the outer post comprises an enlarged portion formed on the top end of the outer post, the enlarged portion adapted to be securely connected to a cushion of the chair.

12. The chair arm as claimed in claim 11, wherein the resilient member is a spring.

13. The chair arm as claimed in claim 8, wherein the resilient member is a spring.

14. The chair arm as claimed in claim 8 further comprising two pushers respectively mounted in the inner post and abutting against an inner periphery of the outer post to prevent the outer post from shaking due to a gap between the inner post and the outer post.

15. The chair arm as claimed in claim 1, wherein the outer post comprises an enlarged portion formed on the top end of the outer post, the enlarged portion adapted to be securely connected to a cushion of the chair.

16. The chair arm as claimed in claim 15, wherein the resilient member is a spring.

* * * * *